United States Patent [19]

Klocke

[11] Patent Number: 4,597,230

[45] Date of Patent: Jul. 1, 1986

[54] LOG CONSTRUCTION DEVICE

[76] Inventor: Donald J. Klocke, 13636 Hamilton Dr. #104, Fountain Hills, Ariz. 85268

[21] Appl. No.: 603,307

[22] Filed: Apr. 24, 1984

[51] Int. Cl.[4] ..... E04B 1/10

[52] U.S. Cl. ..... 52/233; 52/256; 52/257

[58] Field of Search ..... 52/233, 311–315, 52/254, 256, 257; 446/106, 476, 85

[56] References Cited

U.S. PATENT DOCUMENTS 1,294,064 2/1919 Dickson ..... 52/255

FOREIGN PATENT DOCUMENTS 153722 2/1938 Austria ..... 52/233

37557 7/1956 Poland ..... 52/233

189073 11/1922 United Kingdom ..... 52/233

*Primary Examiner*—Carl D. Friedman

*Assistant Examiner*—Naoko N. Slack

*Attorney, Agent, or Firm*—Robert E. Kleve

[57] ABSTRACT

The invention comprises a log wall enclosure having a plurality of walls with each wall comprising a plurality of logs in rows one above the other to form the wall with the logs stacked laterally of the length of the wall. Concrete masonry material is placed between the logs. The walls extend toward one another to form a corner and an L-shaped plate extends along the outer surfaces of the walls where the walls connect to form the corner. The L-shaped plate supports the corner and has strips extending from the plate into the walls to fix the plate to the walls.

2 Claims, 7 Drawing Figures

LOG CONSTRUCTION DEVICE

This invention relates to construction with logs and the like.

It is an object of the invention to provide a novel log construction for buildings, enclosures, and other structures.

It is another object of the invention to provide a novel log structure having logs forming the walls wherein the logs are mounted in the walls laterally of the length of the wall.

It is another object of the invention to provide a novel log construction for buildings and the like where the logs are mounted laterally of the length of the wall each having a length approximately the width of the wall and with insulation between the logs and the masonry between the logs at their ends.

It is another object of the invention to provide a novel log construction for walls wherein the walls are formed of logs stacked laterally of the length of the wall and with an L-shaped support plate along the outer surface of the logs wherein the walls form corners with strips extending from the L-shaped plate in between the logs to secure the L-shaped support plate to the logs.

It is another object of the invention to provide a novel log construction for enclosures, walls, and the like.

Further objects and advantages of the invention will become apparent as the description proceeds and when taken in conjunction with the accompanying drawings wherein.

Briefly stated, the invention comprises an end log construction for building houses and other structures wherein the walls are constructed of a plurality of logs cut laterally of the length of the wall and stacked laterally of the length of the wall to form the wall, insulation and masonry is located between the logs spacing the logs vertically and horizontally from one another, an L-shaped plate support structure is provided at the corners of the construction with the plates fixed to the outer faces of the corners of the walls, strips are fixed to the L-shaped plates at intervals and extend into the masonry between the logs to fix the L-shaped plates to the end logs.

Figure 1:
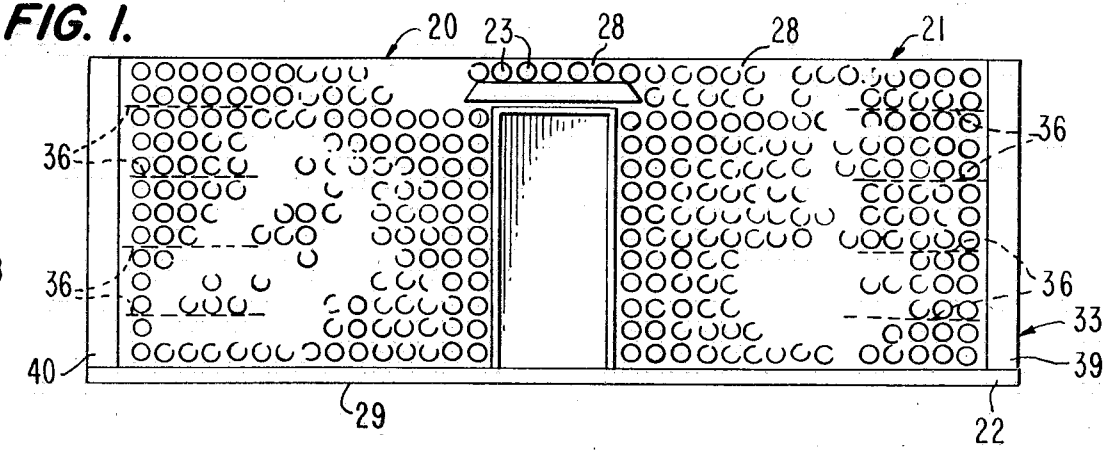
FIG. 1 is a side elevational view of the end log structure illustrating an end log enclosure of the construction of the corners of the structure.

Referring more particularly to the drawings in FIG. 1 the end log building structure 20 is illustrated with a side elevational view of one of the walls 21 and its corners 22. The wall construction comprises a plurality of logs 23 stacked in layers one above the other with the ends 24 and 25 laterally of the length of the wall to form the wall 21. Each log 23 has a pair of annular grooves 26 and 26'. Insulation material 30 is filled centrally between the logs in the space between the logs. Masonry material 28 is filled between the logs at the outer ends 24 and 25 to form the outer surfaces of the walls along with the ends of the logs.

Figure 2:
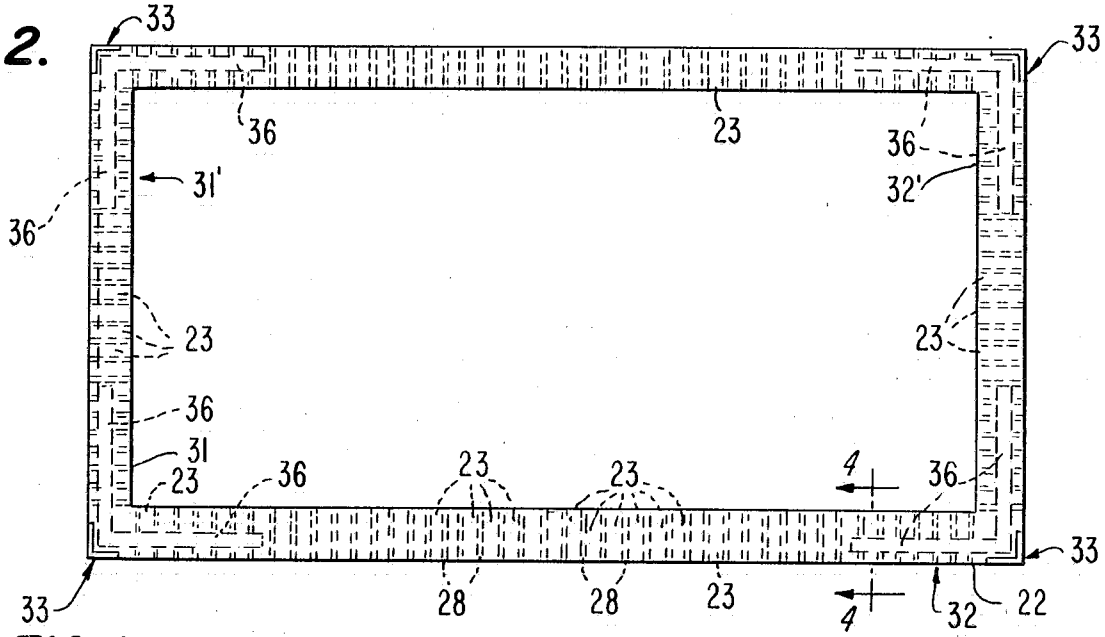
FIG. 2 is a top plan view of a similar end log enclosure structure.

The walls are constructed by applying a layer of the masonry material 28 to a suitable foundation 29 and then laying a layer of the logs 23 laterally of the length of the wall in a row with masonry material applied to the outer ends of the logs vertically between and horizontally along the top of the logs. Then repeat with another layer of logs with masonry material between and subsequent layers until the desired height is reached. Insulation material 30 is filled between the logs. At the corners 31 and 32 and 31' and 32' of the enclosure illustrated in FIG. 2 are L-shaped support plates 33.

The L-shaped support plate structures 33 each have an L-shaped metal plate 34 which is formed of flanges 35 and 35'. The L-shaped support structure has a plurality of wire mesh strips 36 which are bolted to the L-shaped plate 34 at the inner ends 37 by bolts or other suitable means 37'. A horizontal plate 38 is fixed to the lower end of the L-shaped plate 34 by welding. Bolts secure the plate 38 to the concrete foundation of a building in a conventional manner to thereby support the plate 34. Wooden panels 39 and 40 are fixed to the outside plate of the L-shaped plate 34 to form the exterior surface for the corner of the building.

The walls are constructed as described with the logs having annular grooves 26 and 26' in their outer ends which the masonry material fills into. The grooves act to lock the logs together.

Figure 3:
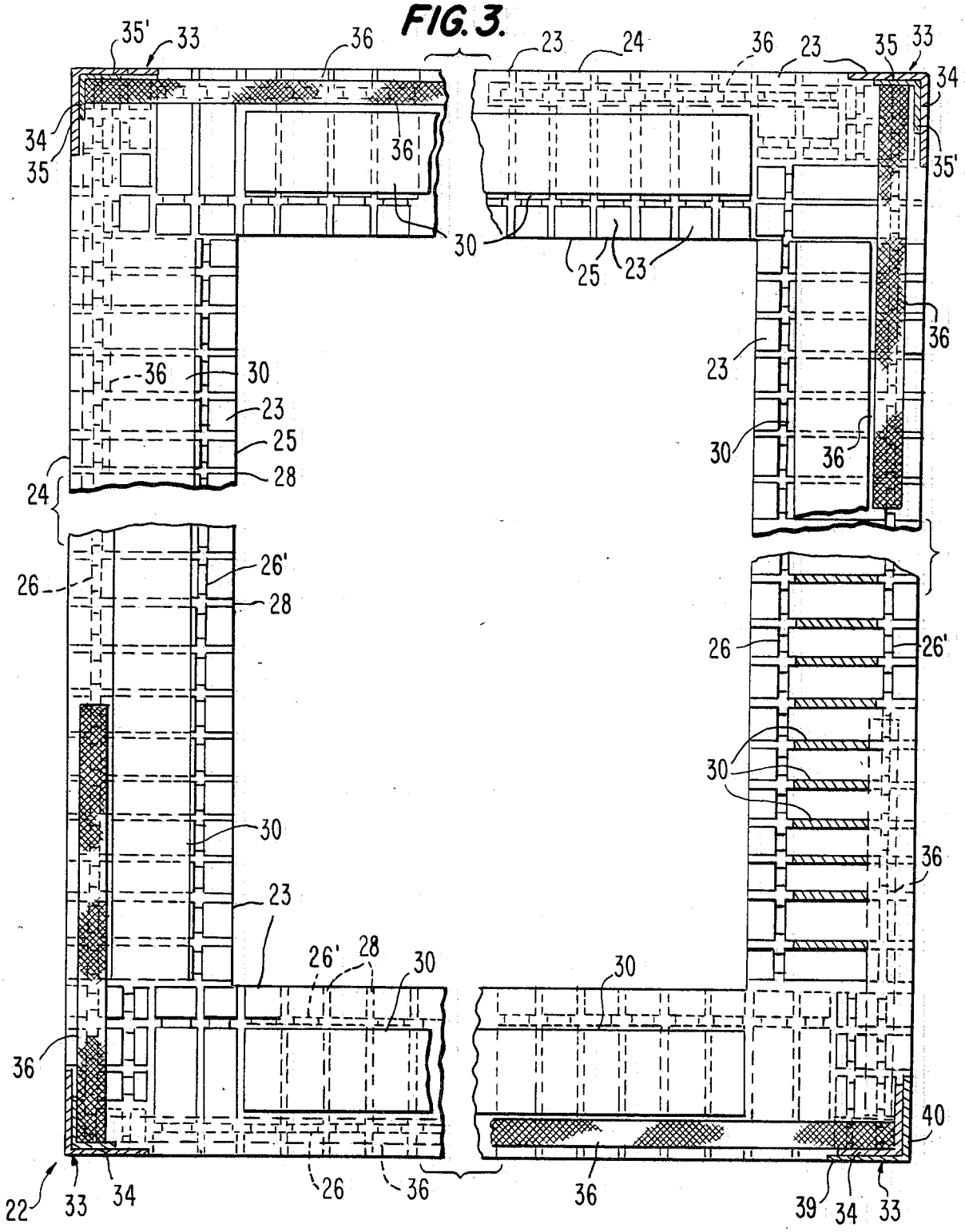
FIG. 3 is a top fragmentary cut-away view of the log enclosure illustrating the construction of the walls.
Figure 5:
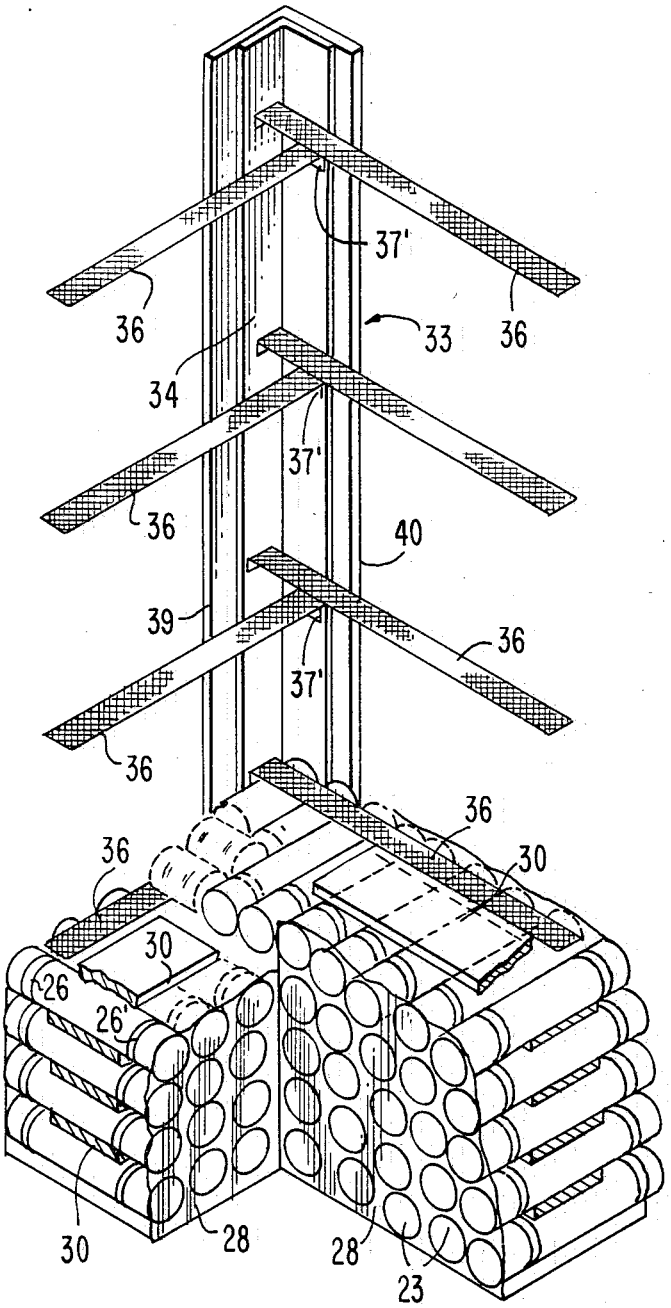
FIG. 5 is a fragmentary perspective view of the corner support structure and corner of an end log enclosure structure where the several walls of the end logs are connected together to form a corner for the enclosure.
Figure 6:
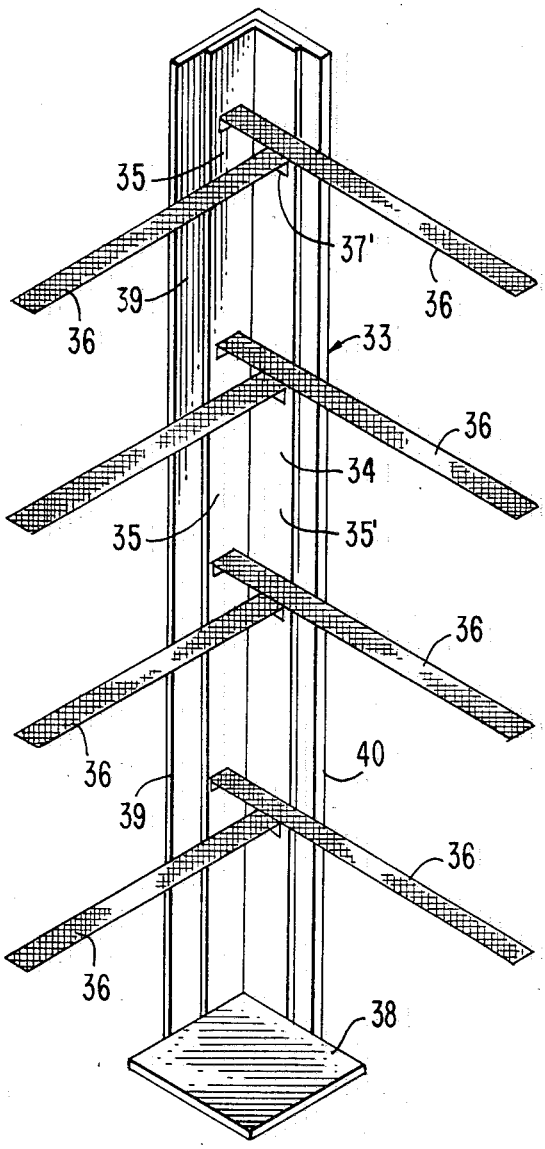
FIG. 6 is a fragmentary perspective view of the corner support structure illustrating the L-shaped plate support and strip member before the end logs have been placed in position to form the wall.

In the corners the logs are stacked in alternate directions. One layer 42 is directed parallel with one wall 43 and the next layer 42' is directed parallel with wall 44 etc. The corner logs can be laid and positioned in several alternate methods, such as illustrated in FIG. 3 to fill in the space in the corners level with the other logs in the walls in each level.

When the walls have been built up horizontally even with the wire mesh strips 36, the strips will be positioned along the logs in the masonry material. This secures the mesh strips to the walls at each corner, thereby fixing the L-shaped plates 34 to the wall at the corners.

The insulation material 30 is filled horizontally and vertically between the logs after the walls have been built using the logs and masonry material and the corner support structure has been secured to the walls. This is done by placing a narrow plastic pipe at intervals vertically and horizontally in the wall. The insulation is pumped in between the logs in the space centrally between the logs and then the plastic pipes are removed from the masonry material and the holes in the masonry where they were located is filled with masonry material.

The L-shaped support structure acts to reinforce the corners of the walls by the strips of wire mesh being fixed in the masonry of the wall at horizontal intervals and the strips being fixed to the L-shaped plates of the support structure to hold the L-shaped plate firmly against the corner of the walls of end logs. Exterior wood panels can act as decorative exterior corner panels for the building and be mounted on the outside of the wooden panels 39 and 40.

Thus, it will be seen that a novel end log construction apparatus or structure has been provided wherein the walls are constructed with logs positioned laterally of the length of the wall in stacked relation to form the wall with masonry material between the logs and insulation material between the logs and with the L-shaped support structure supporting the corners of the walls.

Figure 7:
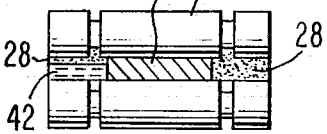
FIG. 7 is a fragmentary view of the wall along a vertical section showing the plastic pipe for installing the insulation.
Figure 4:
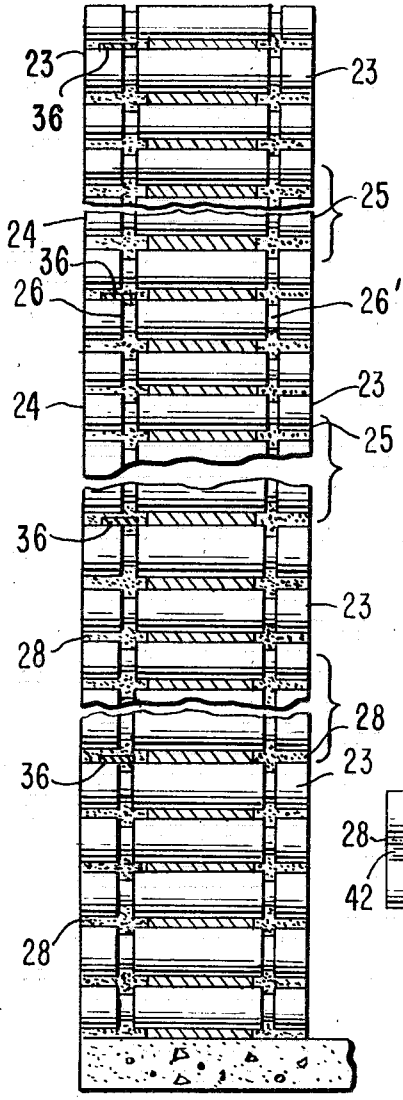
FIG. 4 is a cross-sectional view taken along line 4—4 of FIG. 2 and illustrating in detail the end wall structure with annular grooves in the end logs, and with insulation between the logs and masonry between the logs.

The plastic pipe 42 for pumping the insulation in between the logs is illustrated in FIG. 7. The logs 23 in the corners will include some shorter logs so as to fill out the corners. The insulation may not be used in the corners with the masonry entirely filling out the spacing between the logs.

It will be obvious that various changes and departures may be made to the invention without departing from the spirit and scope thereof and accordingly it is not intended that the invention be limited to that specifically described in the specification and as illustrated in the drawings, but only as set forth in the appended claims wherein what is claimed is:

1. An end log construction apparatus comprising a plurality of logs arranged in horizontal rows one above the other with the ends of logs laterally of the length of the rows, and with the rows arranged in two stacks to form two walls perpendicular to one another and intersecting one another to form a corner, a pair of vertically elongated flanges perpendicular to one another laterally of their length and extending upward in length along the outside of the logs where the logs intersect to form said corner, flexible strips with their one ends fixed to the elongated flanges at vertically spaced intervals and with their other ends extending outward along the two walls horizontally between the horizontal rows of logs at vertical intervals, insulation material mounted between the logs intermediate the inner and outer ends of the logs, masonry material mounted along the inner and outer ends of the logs to form the inner and outer surfaces of the walls adjacent the logs.

2. An end log corner construction apparatus comprising a plurality of logs arranged in rows one above the other with the ends of the logs laterally of the length of the rows, and with the rows arranged in two stacks to form walls perpendicular to one another and intersecting one another, a pair of vertically elongated flanges perpendicular to one another laterally of their length and extending upward in length along the outside of the logs where the logs intersect to form a corner, a base plate secured to the bottom of said flanges for mounted the apparatus to a foundation, said upright flanges having a plurality of elongated wire mesh strips with their one ends fixed to the elongated flanges at vertically spaced intervals and with their other ends extending horizontally outward along the two walls horizontally between the horizontal rows of logs at vertical intervals said strips extending along the outer portions of the walls between the logs, insulation material mounted horizontally between the logs intermediate the inner and outer ends of the logs, masonry material mounted along the inner and outer ends of the logs to form the inner and outer surfaces of the walls adjacent the logs, said logs having annular grooves along their inner and outer ends for receiving the masonry material therein for more securely holding the logs together.

* * * * *